US007007836B2

(12) United States Patent
Smalley

(10) Patent No.: US 7,007,836 B2
(45) Date of Patent: Mar. 7, 2006

(54) PAPERBOARD CARTON WITH REINFORCED HANDLE

(75) Inventor: Brian Leslie Smalley, Downend (GB)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 11/148,463

(22) Filed: Jun. 9, 2005

(65) Prior Publication Data

US 2005/0247767 A1 Nov. 10, 2005

Related U.S. Application Data

(63) Continuation of application No. 10/250,542, filed as application No. PCT/GB02/00077 on Jan. 10, 2002, now Pat. No. 6,926,193.

(30) Foreign Application Priority Data

Jan. 13, 2001 (GB) ..... 0100935

(51) Int. Cl.
*B65D 5/46* (2006.01)

(52) U.S. Cl. ..... 229/117.13; 229/117.14

(58) Field of Classification Search ..... 229/117.13, 229/117.14; 206/141, 427, 434
See application file for complete search history.

(56) References Cited

U.S. PATENT DOCUMENTS

| | | | | |
|---|---|---|---|---|
| 4,498,619 | A | 2/1985 | Roccaforte | |
| 4,546,914 | A | 10/1985 | Roccaforte | |
| 5,639,017 | A | 6/1997 | Fogle | |
| 5,738,273 | A | 4/1998 | Auclair | |
| 5,878,946 | A | 3/1999 | Frerot et al. | |
| 6,019,276 | A | 2/2000 | Auclair | |
| 6,065,590 | A | 5/2000 | Spivey | |
| 6,260,755 | B1 | 7/2001 | Bates et al. | |
| 6,926,193 | B1 * | 8/2005 | Smalley | 229/117.13 |

FOREIGN PATENT DOCUMENTS

| | | |
|---|---|---|
| DE | 296 07 374 U1 | 4/1996 |
| WO | WO 99/28207 | 6/1999 |

* cited by examiner

*Primary Examiner*—Gary E. Elkins
(74) *Attorney, Agent, or Firm*—Womble Carlyle Sandridge & Rice, PLLC

(57) ABSTRACT

A paperboard carton has a base, side panels, end panels, and first and second top panels. The first top panel defines a strap handle and underlies the second top panel. The second top panel provides access to the strap handle. The strap handle extends into first end panels and second end panels having reinforcing portions are secured to those parts of the strap handle in the first end panels.

34 Claims, 5 Drawing Sheets

PAPERBOARD CARTON WITH REINFORCED HANDLE

CROSS-REFERENCE TO RELATED APPLICATION

Figure 1:
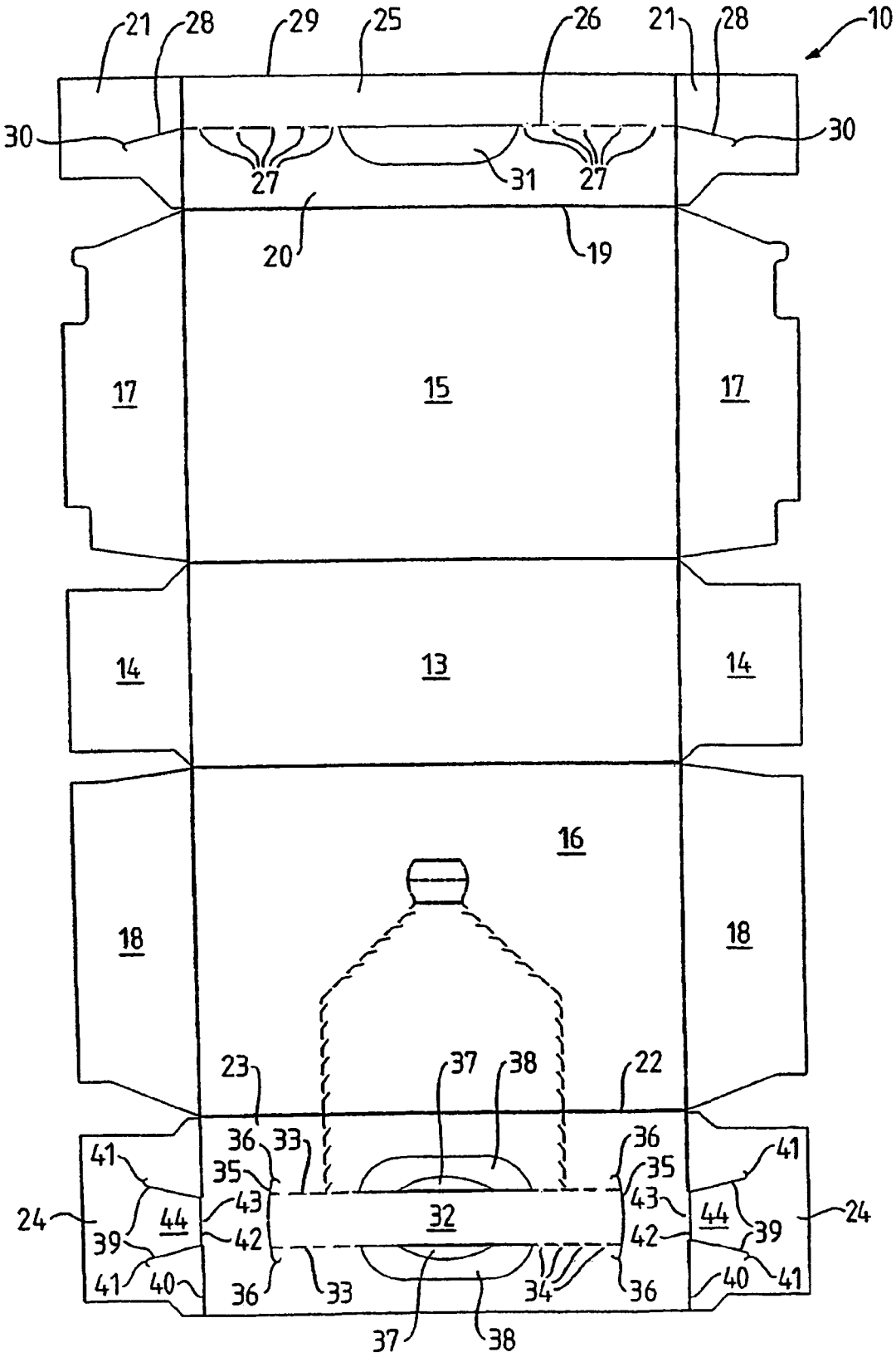

This application is a continuation of U.S. patent application Ser. No. 10/250,542 filed Oct. 27, 2003, U.S. Pat. No. 6,926,193, which is the National Stage of International Application No. PCT/GB02/00077 filed Jan. 10, 2002, which is hereby incorporated herein by reference in its entirety.

The present invention relates to paperboard cartons and more particularly, but not exclusively to cartons for containing a number of cans or bottles as a multipack.

According to the present invention there is provided a carton having a base, oppositely disposed side walls extending from the base and first and second top panels hingedly connected to respective side walls along first and second top side edges, each top panel having oppositely disposed end panels which are folded down and secured relative to other end panels, said first top panel underlying the second top panel and having a portion disposed parallel to the top side edges and constituting by means of one or more cuts a strap handle extending the length of the top and into the first end panels, the second top panel having access means for enabling the strap handle to be gripped, the second end panels each having a reinforcing portion adhered to the associated part of the strap handle in the first end panels and defined between a pair of spaced cuts and the fold between the second end panels and the second top panel.

Preferably the reinforcing portions of the second end panels are connected to the second top panel by way of frangible bridges. Conveniently the spaced cuts taper away from each other from spaced locations on the top side edges and also the spaced cuts terminate with outwardly extending radiuses.

Ideally the adhesive connection between the strap handle and each reinforcing portion extends from immediately adjacent the top edge of the reinforcing portion to the free edge of the end panels remote from the top edge.

In preferred embodiments the cuts defining the strap handle in the first end panels are disposed below the associated cuts in the second end panels and also the centrally disposed portion of the first top panel is a marginal edge portion of the first top panel.

It is a preferred feature that the second top panel has a secondary handle portion which overlies the strap handle and is adhered thereto. Preferably midway between its ends, the secondary handle portion has lateral flaps which in use can be folded around the strap handle.

A further preferred feature is that said access means comprises openings on either side of the central portion of the secondary handle portions. In addition the secondary handle portion extends at its lengthwise ends beyond the openings towards the second end panels by means of further spaced cuts which terminate in a transverse cut at each end, which transverse cuts are spaced from the respective top end edges. Ideally frangible bridges are provided in the further spaced cuts and transverse cuts.

In preferred arrangements the base has oppositely disposed base end panels which are folded up and each side wall has oppositely disposed side end panels, the base end panels and side end panels constituting said other end panels. Normally, the top, base, sides and ends of the carton are substantially rectangular.

Figure 2:
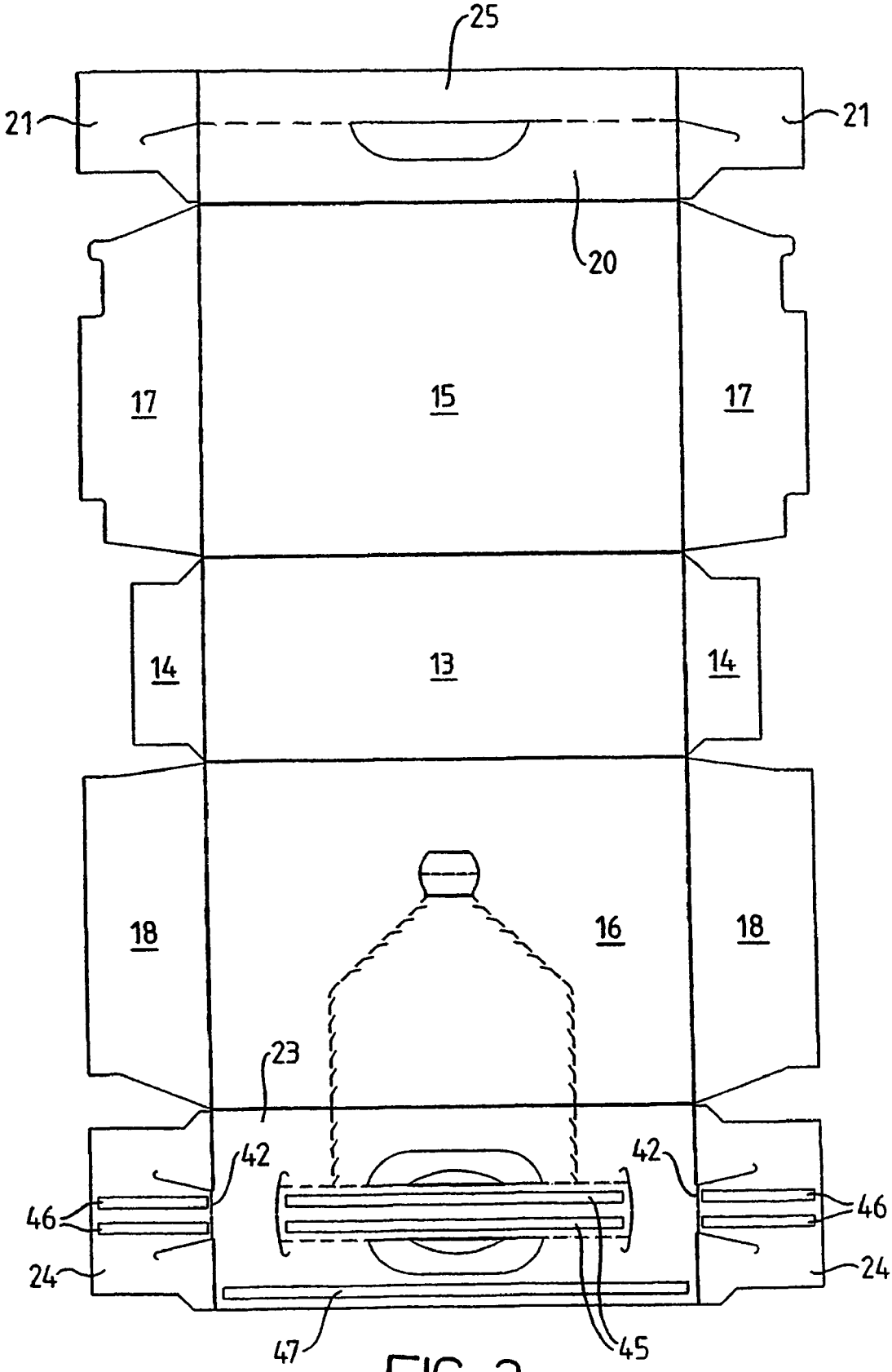
Figure 3:
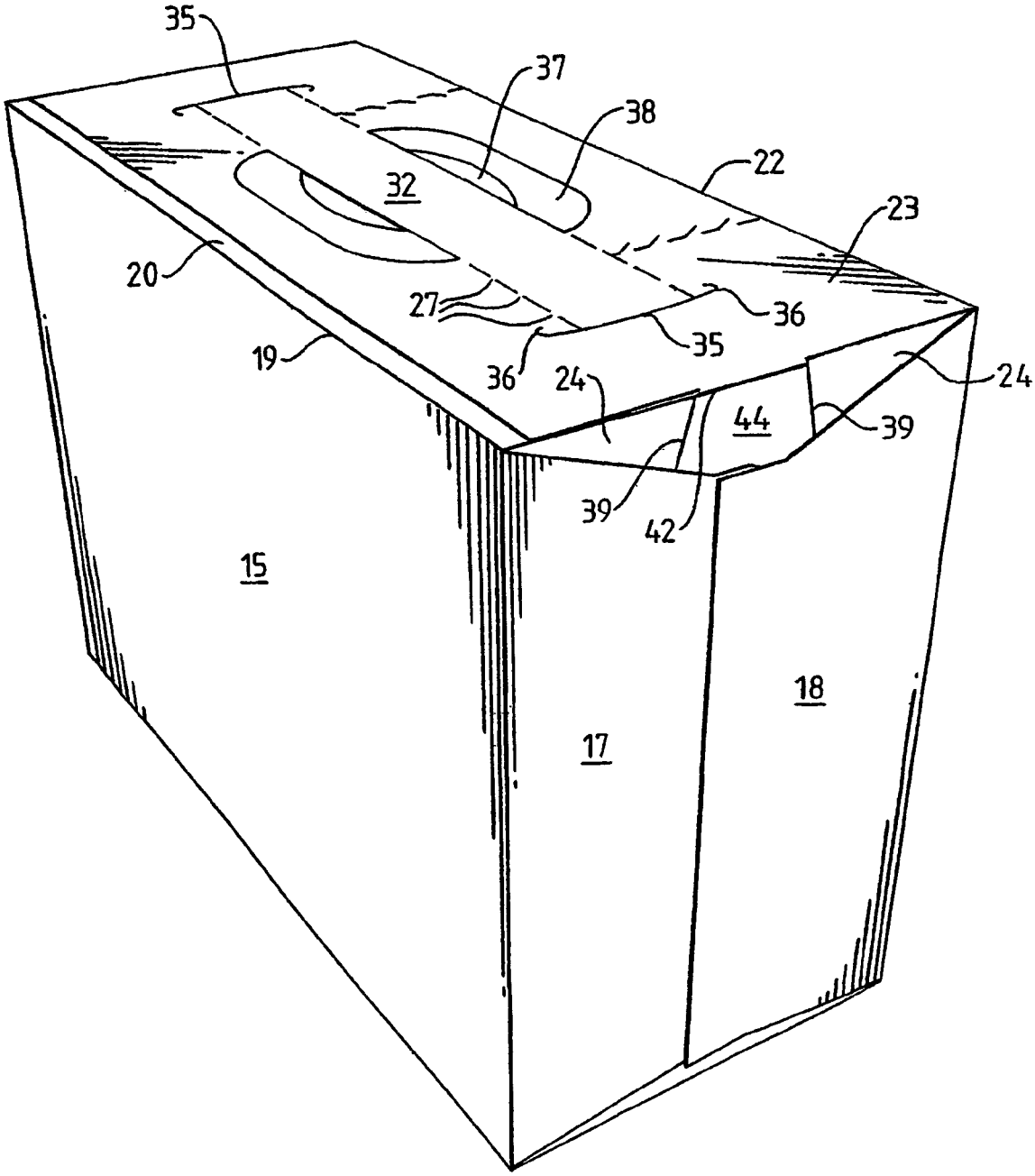
Figure 4:
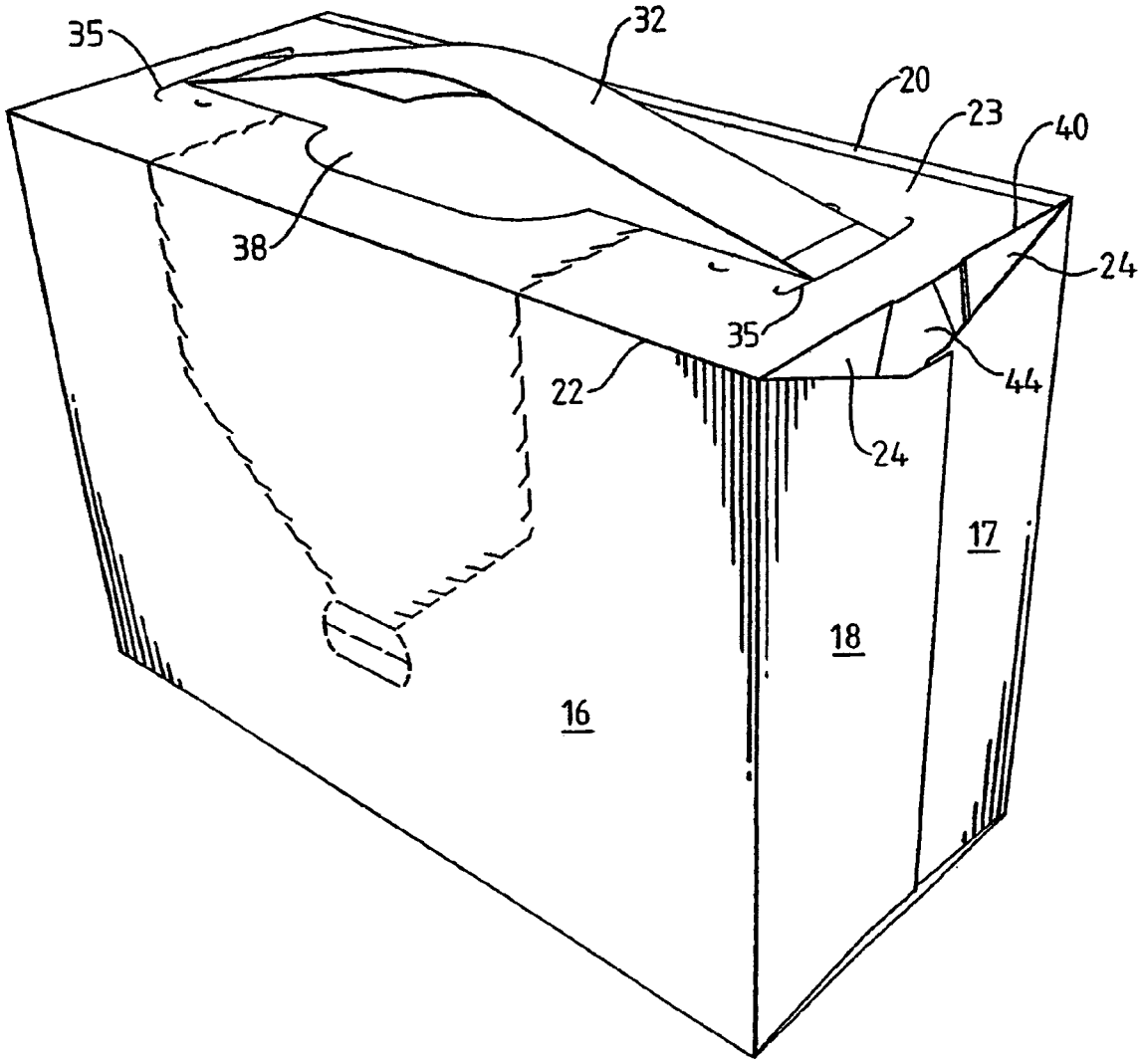
Figure 5:
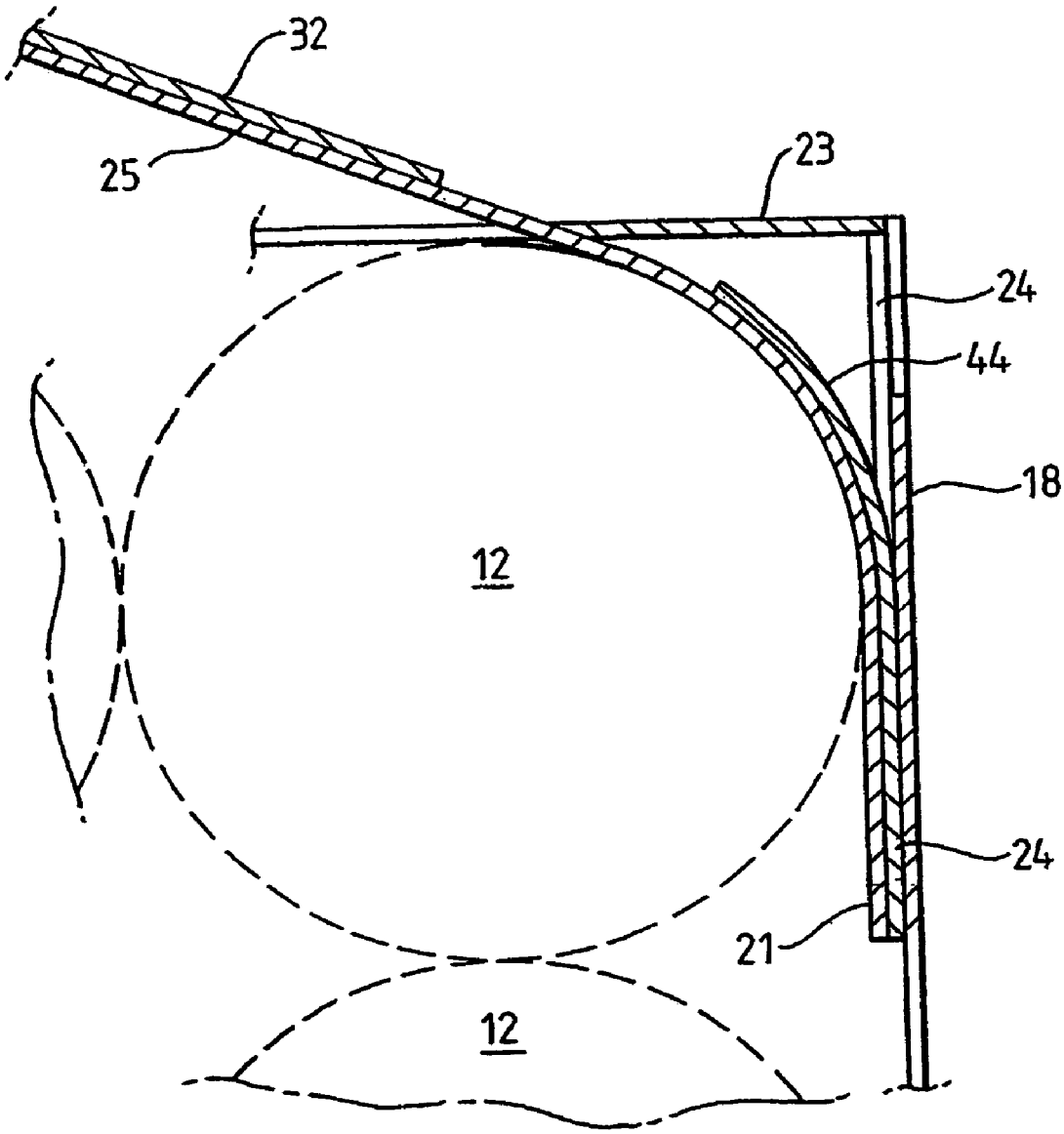

Embodiments of the invention will now be described in more detail. The description makes reference to the accompanying drawings in which:

FIG. 1 shows the inside of a paperboard blank for producing a carton according to the present invention, FIG. 2 shows the inside of the FIG. 1 blank with some glue lines included, FIG. 3 shows a perspective view from one side of the carton according to the present invention, FIG. 4 shows a perspective view from the other side of the carton with its handle raised, and FIG. 5 is an exaggerated partial view of a central, lengthwise section through the carton.

In the figures is shown a paperboard blank 10 for producing a carton 11 containing a number of articles such as cans 12. The blank 10 provides a rectangular base 13 having oppositely disposed base end panels 14 hingedly connected thereto. Side panels 15, 16 are hingedly connected to opposite side edges of the base 13 and each side panel 15, 16 has oppositely disposed side end panels 17, 18 hingedly connected thereto. Hingedly connected to one side panel 15 along a first top edge 19 is a first top panel 20 having oppositely disposed first end panels 21. Hingedly connected to the second side panel 16 along a second top edge 22 is a second top panel 23 having oppositely disposed second end panels 24.

The marginal portion of the first top panel 20 parallel to the first top edge 19 defines a strap handle 25 by means of a cut line 26 which, in this example, incorporates frangible bridges 27 at intervals along its length. The cut line 26 leads into end panel cuts 28 which taper outwardly away from the free edge 29 of the first top panel. Each cut 28 extends only partly into the first end panel 21 and terminates with a stress relieving radius 30. At the central area of the first top panel 20 is an opening 31 adjacent the strap handle for handle access purposes.

The second top panel 23, which when assembled overlies the first top panel 20 has a central secondary strap handle portion 32 which in use is glued on top of the strap handle 25 of the first top panel 20. The secondary strap handle portion 32 is defined between parallel cuts 33 which are arranged to be centrally disposed in the top of the assembled carton 11 and which preferably incorporate frangible bridges 34 along their length. The ends of the handle portion 32 are defined by transverse cuts 35 spaced from the respective second end panels 24. The transverse cuts 35 ideally incorporate stress-relieving radii 36 at their ends and the ends of each transverse cut 35 are slightly away from its adjacent end panel.

At a central location of the handle portion 32, arcuate lateral flaps 37 are provided. Handle access openings 38 are also provided in the second top panel 23 on both sides of the handle portion 32.

In each second end panel 24 are provided a pair of cuts 39 which taper outwardly from spaced locations in the fold line 40 between the second top panel 23 and the second end panel 24. The ends of the cuts 39 remote from the fold line 40 are each provided with a stress-relieving radius 41. The fold line 40 between each pair of cuts is actually a further cut 42 which is provided with a frangible bridge 43. The further cut 42 and the cuts 39 each defining therebetween a reinforcing portion 44 of the second end panel 24.

When the blank 10 is assembled to form the carton 11 and the articles are enclosed with the carton, the handle portion 32 has been glued to the strap handle 25 by means of glue lines 45 shown on FIG. 2 and the first and second end panels 21, 24 have been glued to each other by means of glue lines 46 shown in FIG. 2. A further glue line 47 secures the free edge of the second top panel 23 to the first-top panel 20. It will be seen that the glue lines 46 extend from adjacent the cut portion 42 of the fold line 40 to adjacent the free edge of the end panels. The strap handle 25 is, therefore, glued to second end panels 24 substantially along the whole length of the second end panels to improve handle strength.

With the carton 11 is to be lifted, the consumer can insert fingers through the openings 31, 38 to grasp the strap handle 25 from below, the flaps 37 being folded below the strap handle 25. When the handle is lifted, the frangible bridges 27, 34, 43 are severed such that the central portion of the strap handle 25 and secondary handle portion 32 are raised out of the plane of the top of the carton 11. The reinforcing portions 44 of the second end panels 24 are also pulled inwardly so as to follow the contours of the top corner articles. This is shown more clearly in FIG. 5 which shows one of the top corners on an enlarged and exaggerated scale. The part of the second end flap 24 below the reinforcing portion 44 is secured to the side end panels 17, 18. The resulting handle is strong yet the original carton prior to lifting maintains a neat appearance with minimal openings or surface discontinuities.

It will be appreciated that the precise shape and dimensions of the described features are a matter of design choice and modifications can be made without departing from the scope of the invention. For example, the carton could be adapted for use with other types of articles such as bottles.

What is claimed is:

1. A carton blank, comprising:

a base;

a first side panel;

a second side panel;

a first top panel;

a second top panel;

oppositely disposed first end panels foldably connected to the first top panel; and oppositely disposed second end panels foldably connected to the second top panel, each second end panel comprising a reinforcing portion defined by a pair of spaced cuts, wherein the first top panel comprises a strap handle defined by one or more cuts, the strap handle extending along a length of the first top panel, and the second top panel comprises a secondary handle portion spaced from the reinforcing portions and defined by spaced handle cuts extending along a length of the second top panel, wherein the secondary handle portion terminates at a first end in a first transverse cut extending substantially along a width of the second top panel.

2. The blank of claim 1, wherein the strap handle extends into the first end panels.

3. The blank of claim 2, wherein the strap handle is defined on one side by at least a first cut of the one or more cuts and on a second side by a free edge of the first top panel, the first cut extending across the length of the first top panel.

4. The blank of claim 3, wherein the first top panel further comprises access means adjacent to the strap handle.

5. The blank of claim 1, wherein the spaced cuts in each of the pairs of spaced cuts taper away from each other and terminate with outwardly extending radiuses.

6. The blank of claim 5, wherein the second end panels are each connected to the second top panel at a respective fold, the folds defining ends of the reinforcing portions.

7. The blank of claim 5, wherein the secondary handle portion comprises lateral flaps.

8. The blank of claim 1, wherein the second top panel comprises access means adjacent to the secondary handle portion for allowing access through the second top panel.

9. The blank of claim 8, wherein the access means comprises an opening on either side of a central portion of the secondary handle portion.

10. The blank of claim 1, wherein a second end of the secondary handle portion terminates in a second transverse cut extending substantially along a width of the second top panel.

11. The blank of claim 10, wherein the secondary handle portion comprises lateral flaps located between the first and second ends of the secondary handle portion.

12. The blank of claim 11, wherein the second top panel further comprises an opening on each side of a central portion of the secondary handle portion.

13. The blank of claim 1, wherein the spaced handle cuts defining the secondary handle portion comprise frangible bridges.

14. The blank of claim 1, further comprising base end panels foldaby connected to the base panel.

15. The blank of claim 14, wherein the base and the side panels of the carton are substantially rectangular.

16. A carton formed from the blank of claim 1.

17. A blank, comprising:

a base;

a first side panel;

a second side panel;

a first top panel;

a second top panel;

oppositely disposed first end panels foldably connected to the first top panel; and oppositely disposed second end panels foldably connected to the second top panel, each second end panel comprising a reinforcing portion defined by a pair of spaced cuts, each reinforcing portion being connected to the second top panel at a frangible bridge, wherein the first top panel comprises a strap handle defined by one or more cuts, the strap handle extending along a length of the first top panel, and the second top panel comprises a secondary handle portion spaced from the reinforcing portions and defined by spaced handle cuts.

18. The blank of claim 17, wherein the spaced cuts in each of the pairs of spaced cuts taper away from each other and terminate with outwardly extending radiuses.

19. The blank of claim 17, wherein the strap handle extends into the first end panels.

20. The blank of claim 19, wherein the strap handle is defined on one side by at least a first cut of the one or more cuts and on a second side by a free edge of the first top panel, the first cut extending across the length of the first top panel.

21. The blank of claim 17, wherein the secondary handle portion comprises lateral flaps.

22. The blank of claim 17, wherein the second top panel comprises access means adjacent to the secondary handle portion for allowing access through the second top panel.

23. The blank of claim 17, wherein:

the secondary handle portion terminates at a first end in a first transverse cut extending substantially along a width of the second top panel; and a second end of the secondary handle portion terminates in a second transverse cut extending substantially along the width of the second top panel.

24. The blank of claim 17, wherein the secondary handle portion comprises:

lateral flaps located between first and second ends of the secondary handle portion; and an opening on either side of the secondary handle portion.

25. The blank of claim 17, further comprising base end panels foldaby connected to the base panel.

26. A carton formed from the blank of claim 17.

27. A carton blank, comprising:

a base;

a first side panel;

a second side panel;

a first top panel;

a second top panel;

oppositely disposed first end panels foldably connected to the first top panel; and oppositely disposed second end panels foldably connected to the second top panel, each second end panel comprising a reinforcing portion defined by a pair of spaced cuts, wherein each reinforcing portion is defined in part by an edge of the second top panel, wherein the first top panel comprises a strap handle defined by one or more cuts, the strap handle extending along a length of the first top panel, and the second top panel comprises a secondary handle portion spaced from the reinforcing portions and defined by spaced handle cuts.

28. The blank of claim 27, wherein portions of the edges of the top panel defining each of the reinforcing portions each comprise a frangible bridge.

29. The blank of claim 27, wherein the spaced cuts in each of the pairs of spaced cuts taper away from each other and terminate with outwardly extending radiuses.

30. The blank of claim 27, wherein the strap handle extends into the first end panels, and wherein the strap handle is defined on one side by at least a first cut of the one or more cuts and on a second side by a free edge of the first top panel, the first cut extending across the length of the first top panel.

31. The blank of claim 27, wherein the secondary handle portion comprises lateral flaps and the second top panel comprises access means adjacent to the secondary handle portion for allowing access through the second top panel.

32. The blank of claim 27, wherein:

the secondary handle portion terminates at a first end in a first transverse cut extending substantially along a width of the second top panel; and a second end of the secondary handle portion terminates in a second transverse cut extending substantially along the width of the second top panel.

33. The blank of claim 27, wherein the secondary handle portion comprises:

lateral flaps located between first and second ends of the secondary handle portion; and an opening on either side of the secondary handle portion.

34. A carton formed from the blank of claim 27.

* * * * *